US010120301B1

(12) United States Patent
Ota

(10) Patent No.: US 10,120,301 B1
(45) Date of Patent: Nov. 6, 2018

(54) DEVELOPING DEVICE AND IMAGE FORMING APPARATUS INCLUDING SAME

(71) Applicant: KYOCERA Document Solutions Inc., Osaka (JP)

(72) Inventor: Yukari Ota, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/941,963

(22) Filed: Mar. 30, 2018

(30) Foreign Application Priority Data

May 8, 2017 (JP) ..... 2017-092347

(51) Int. Cl.
*G03G 15/08* (2006.01)

(52) U.S. Cl.
CPC ..... *G03G 15/0893* (2013.01); *G03G 15/0889* (2013.01); *G03G 2215/0819* (2013.01)

(58) Field of Classification Search
CPC ..... G03G 15/0893; G03G 15/0891; G03G 15/0889; G03G 2215/0819; G03G 2215/083; G03G 2215/0838
See application file for complete search history.

(56) References Cited

U.S. PATENT DOCUMENTS

2011/0013944 A1* 1/2011 Kawaguchi ..... G03G 15/0893 399/257
2011/0311279 A1* 12/2011 Okazaki ..... G03G 15/0893 399/254
2011/0318062 A1* 12/2011 Hayashi ..... G03G 15/0822 399/254
2014/0235415 A1 8/2014 Nakajima et al. ..... 492/35
2016/0209777 A1* 7/2016 Mugita ..... G03G 15/0891
2016/0216640 A1* 7/2016 Nose ..... G03G 15/0891
2017/0115606 A1* 4/2017 Sakamaki ..... G03G 15/0891
2017/0123349 A1* 5/2017 Takahashi ..... G03G 15/0893

FOREIGN PATENT DOCUMENTS

JP 2014-160162 A 9/2014

* cited by examiner

*Primary Examiner* — Sophia S Chen
(74) *Attorney, Agent, or Firm* — Stein IP, LLC

(57) ABSTRACT

A developing device of the present disclosure includes a developing container, a first stirring-conveyance member, a second stirring-conveyance member, and a developer carrier. The developing container includes a first conveyance chamber, and a second conveyance chamber arranged above the first conveyance chamber. The first stirring-conveyance member conveys a developer in the first conveyance chamber in a first direction, while stirring the developer. The second stirring-conveyance member conveys the developer in the second conveyance chamber in a second direction, while stirring the developer. The first stirring-conveyance member includes a plurality of spiral blades formed on an outer peripheral surface of a rotary shaft, and a reverse spiral blade which is arranged downstream of the spiral blades in the first direction and opposite in winding direction to the spiral blades. Downstream ends of the spiral blades in the first direction are located substantially equally distant from the reverse spiral blade.

8 Claims, 5 Drawing Sheets

DEVELOPING DEVICE AND IMAGE FORMING APPARATUS INCLUDING SAME

INCORPORATION BY REFERENCE

This application is based upon and claims the benefit of priority from the corresponding Japanese Patent Application No. 2017-092347 filed on May 8, 2017, the entire contents of which are incorporated herein by reference.

BACKGROUND

The present disclosure relates to a developing device and an image forming apparatus including the same, and in particular, to a developing device including a first conveyance chamber and a second conveyance chamber arranged above the first conveyance chamber, the first and second conveyance chambers each having arranged therein a stirring-conveyance member for stirring and conveying a developer, and an image forming apparatus including such a developing device.

In an image forming apparatus, an electrostatic latent image formed on an image carrier, such as a photosensitive body, is developed and visualized as a toner image by a developing device. A known example of such a developing device is a developing device that includes a developing container which contains a developer, a first stirring-conveyance member and a second stirring-conveyance member which stir and convey the developer, and a developing roller (a developer carrier) which carries thereon the developer supplied thereto from the second stirring-conveyance member. The first stirring-conveyance member conveys the developer to one side in an axial direction of the developing roller, and the second stirring-conveyance member supplies the developer to the developing roller, while conveying the developer to the other side (opposite side of the one side).

Now, in recent years, there has been an increasing demand for compact image forming apparatuses, and in particular, in color image forming apparatuses, in which a plurality of developing devices are arranged, there has been a demand for compact developing devices.

In this regard, there is known a developing device that includes a first conveyance chamber in which a first stirring-conveyance member is arranged and a second conveyance chamber which is arranged above the first conveyance chamber and in which a second stirring-conveyance member is arranged. Such a developing device can be made compact in the horizontal direction by arranging the first conveyance chamber and the second conveyance chamber one above the other. Accordingly, it is possible to reduce space for installing developing devices, and thus, to achieve compact image forming apparatuses.

Conventionally, there has also been known a developing device which includes a first stirring-conveyance member and a second stirring-conveyance member which stir and convey a developer, a first conveyance chamber in which the first stirring-conveyance member is arranged, and a second conveyance chamber in which the second stirring-conveyance member is arranged, the first stirring-conveyance member including a rotary shaft, two spiral blades (a double-spiral blade) formed on the outer peripheral surface of the rotary shaft to convey the developer in a first direction, and a reverse spiral blade which is opposite in winding direction to the two spiral blades and arranged downstream of the two spiral blades in the first direction.

In this developing device, when the first stirring-conveyance member rotates, the reverse spiral blade applies, to the developer, conveying force in a direction that is opposite to the direction in which the developer is conveyed by the two spiral blades. This conveying force in the opposite direction applies pressure such that the developer becomes heaped up high on a downstream side in the first conveyance chamber, and thereby, the developer is conveyed from the first conveyance chamber into the second conveyance chamber.

SUMMARY

According to one aspect of the present disclosure, a developing device includes a developing container, a first stirring-conveyance member, a second stirring-conveyance member, and a developer carrier. The developing container includes a first conveyance chamber and a second conveyance chamber arranged above the first conveyance chamber, and contains a developer which contains a toner. The first stirring-conveyance member is rotatably supported in the first conveyance chamber, and conveys the developer in the first conveyance chamber in a first direction, while stirring the developer. The second stirring-conveyance member is rotatably supported in the second conveyance chamber, and conveys the developer in the second conveyance chamber in a second direction opposite to the first direction, while stirring the developer. The developer carrier is rotatably supported in the developing container, and carries on a surface thereof the developer in the first conveyance chamber or the second conveyance chamber. The developing container further includes a partition section which divides the first conveyance chamber and the second conveyance chamber from each other, a first communication section which allows the first conveyance chamber and the second conveyance chamber to communicate with each other at downstream-side end portions thereof in the first direction, and a second communication section which allows the first conveyance chamber and the second conveyance chamber to communicate with each other at downstream-side end portions thereof in the second direction. The first stirring-conveyance member includes a rotary shaft, a plurality of spiral blades formed on an outer peripheral surface of the rotary shaft, and a reverse spiral blade which is arranged downstream of the plurality of spiral blades in the first direction to face the first communication section, and which is opposite in winding direction to the plurality of spiral blades. Downstream ends of the plurality of spiral blades in the first direction are located substantially equally distant from the reverse spiral blade.

Further features and advantages of the present disclosure will become apparent from the description of embodiments given below.

DETAILED DESCRIPTION

Figure 1:
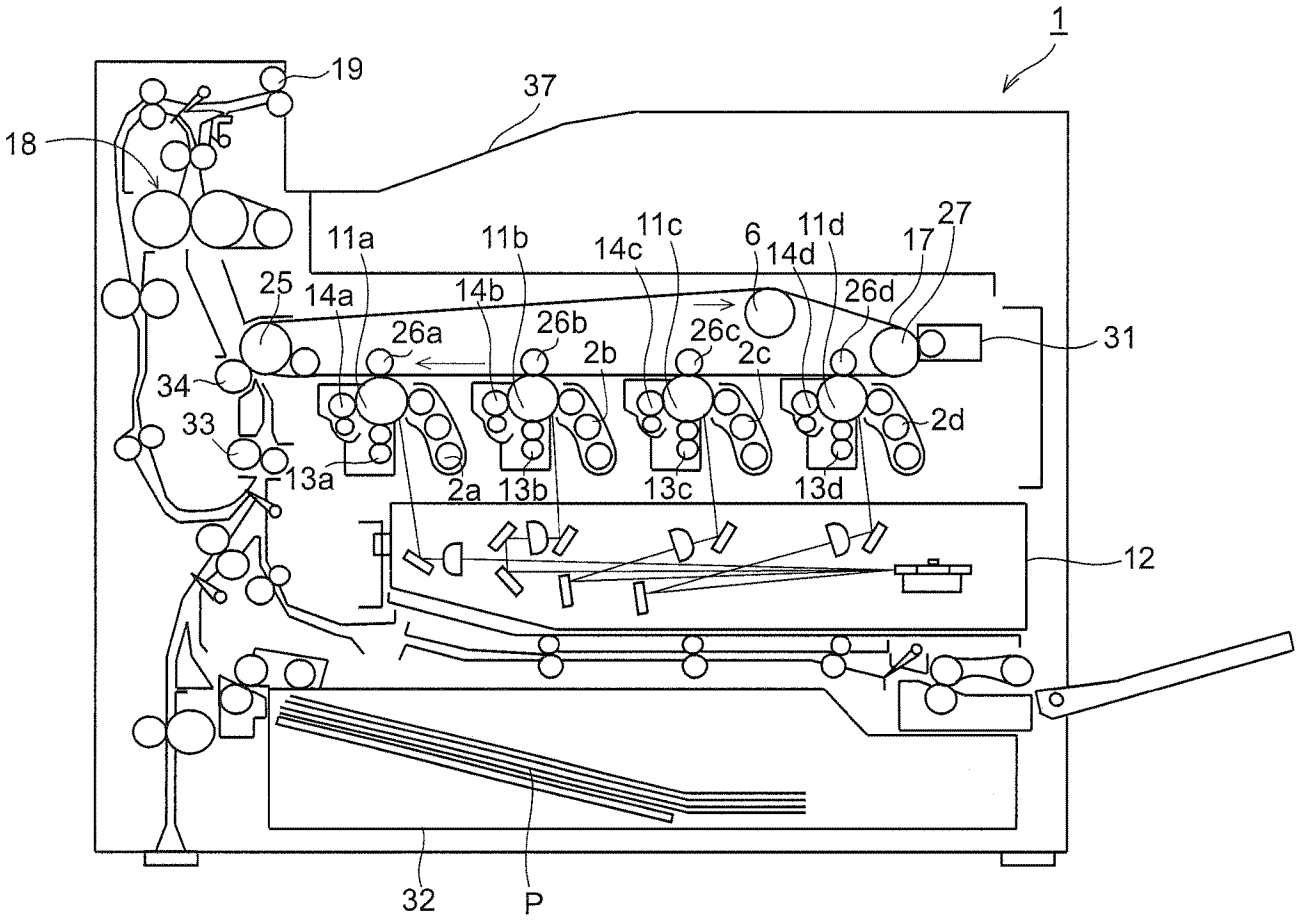
FIG. 1 is a sectional view schematically showing an overall configuration of an image forming apparatus that includes a developing device of a first embodiment of the present disclosure.

Hereinafter, embodiments of the present disclosure will be described with reference to the accompanying drawings.

First Embodiment

With reference to FIG. 1 to FIG. 5, a description will be given of a structure of an image forming apparatus 1 including developing devices 2*a* to 2*d* of a first embodiment of the present disclosure. The image forming apparatus 1 of the present embodiment is a tandem-type color printer, in which rotatable photosensitive drums (image carriers) 11*a* to 11*d* are arranged each corresponding to one of the colors of magenta, cyan, yellow, and black. Around the photosensitive drums 11*a* to 11*d*, there are arranged developing devices 2*a* to 2*d*, an exposure unit 12, chargers 13*a* to 13*d*, and cleaning devices 14*a* to 14*d*.

The developing devices 2*a* to 2*d* supply toner to the photosensitive drums 11*a* to 11*d*. The chargers 13*a* to 13*d* are arranged facing surfaces of the photosensitive drums 11*a* to 11*d*, and uniformly charge the surfaces of the photosensitive drums 11*a* to 11*d*.

The exposure unit 12 scans and exposes the photosensitive drums 11*a* to 11*d* based on image data fed to an image input section (not shown) from a personal computer or the like. By the exposure unit 12, electrostatic latent images are formed on the surfaces of the photosensitive drums 11*a* to 11*d*, and these electrostatic latent images are developed into toner images by the developing devices 2*a* to 2*d*.

An endless intermediate transfer belt 17 is wound around a tension roller 6, a driving roller 25, and a driven roller 27. The driving roller 25 is driven to rotate by a motor, which is not shown, and the intermediate transfer belt 17 is driven to circulate by the rotation of the driving roller 25.

The photosensitive drums 11*a* to 11*d* are arranged under, and in contact with, the intermediate transfer belt 17, to be aligned side by side along a conveyance direction (a direction indicated by an arrow in FIG. 1). Primary transfer rollers 26*a* to 26*d* are arranged opposite the photosensitive drums 11*a* to 11*d* across the intermediate transfer belt 17, and are pressed into contact with the intermediate transfer belt 17 to form a primary transfer section. At the primary transfer section, along with the rotation of the intermediate transfer belt 17, the toner images on the photosensitive drums 11*a* to 11*d* are sequentially transferred onto the intermediate transfer belt 17 with predetermined timing. In this way, on a surface of the intermediate transfer belt 17, a full-color toner image is formed in which the toner images of the four colors of magenta, cyan, yellow, and black are superimposed one on another.

A secondary transfer roller 34 is arranged opposite the driving roller 25 across the intermediate transfer belt 17, and is pressed into contact with the intermediate transfer belt 17 to form a secondary transfer section. In the secondary transfer section, the toner image on the surface of the intermediate transfer belt 17 is transferred onto a sheet P. After the transfer is completed, a belt cleaning device 31 removes residual toner from the intermediate transfer belt 17.

In a lower portion inside the image forming apparatus 1, a sheet feed cassette 32 is disposed which contains sheets P, and to the right of the sheet feed cassette 32, a stack tray is disposed for manual sheet feeding. In an upper left portion of the image forming apparatus 1, a fixing section 18 is disposed which performs fixing processing with respect to the sheet P on which the image has been formed.

A sheet P fed out from the sheet feed cassette 32 or the stack tray is conveyed by a registration roller pair 33 to the second transfer section with timing coordinated with the image forming operation performed at the intermediate transfer belt 17 and the sheet feeding operation. To the sheet P conveyed to the secondary transfer section, the full color toner image on the intermediate transfer belt 17 is secondarily transferred by the secondary transfer roller 34, to which a bias potential is applied, and the sheet P is then conveyed to the fixing section 18.

The fixing section 18 includes components such as a fixing belt to which heat is applied by a heater, a fixing roller which is in contact with an inner surface of the fixing belt, and a pressure roller which is disposed to be pressed into contact with the fixing roller with the fixing belt therebetween, and the fixing section 18 performs the fixing process by applying heat and pressure to the sheet P onto which the toner image has been transferred. The sheet P which has passed through the fixing section 18 is guided by a branching section into one of a plurality of conveyance directions into which the branching section is branched, and then the sheet P is ejected as it is (or after it is sent to a double-sided printing conveyance path and double-sided printing is completed thereon) to a sheet ejection section 37 by an ejection roller pair 19.

Next, a description will be given of a detailed structure of the developing device 2*a* with reference to FIG. 2. The following description will deal with the structure and the operation of the developing device 2*a* corresponding to the photosensitive drum 11*a* shown in FIG. 1. The structures and operations of the developing devices 2*b* to 2*d* are similar to those of the developing device 2*a*, and therefore no overlapping descriptions thereof will be repeated. Moreover, the suffixes "a" to "d" distinguishing the developing devices and the photosensitive bodies for different colors will be omitted.

Figure 2:
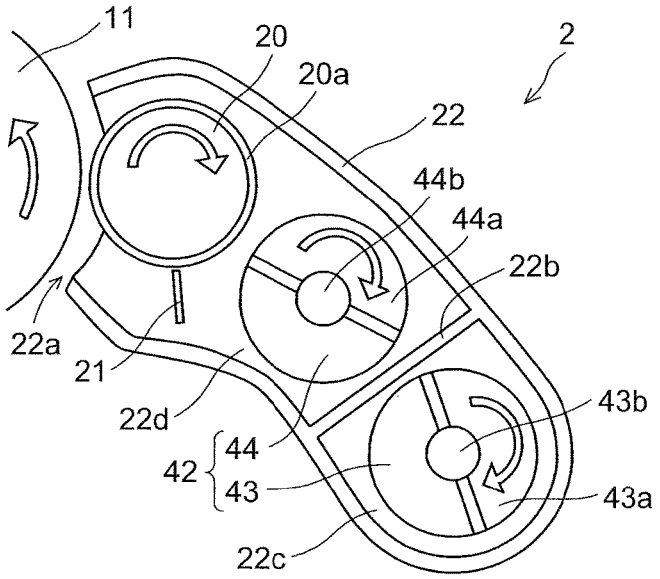
FIG. 2 is a sectional view showing a structure of the developing device of the first embodiment of the present disclosure.

As shown in FIG. 2, the developing device 2 includes a developing roller (a developer carrier) 20, a stirring-conveyance member 42, and a developing container 22.

The developing container 22 constitutes a housing of the developing device 2, and is divided, by a partition section 22*b*, into a first conveyance chamber 22*c* and a second conveyance chamber 22*d*. The first conveyance chamber 22*c* and the second conveyance chamber 22*d* contain a two-component developer which contains a toner and a carrier. The developing container 22 rotatably holds the stirring-conveyance member 42 and the developing roller 20. Moreover, in the developing container 22, there is formed an opening 22*a* through which the developing roller 20 is exposed toward the photosensitive drum 11.

The stirring-conveyance member 42 includes two stirring-conveyance members, namely, a first spiral (a first stirring-conveyance member) 43 and a second spiral (a second stirring-conveyance member) 44. The first spiral 43, which is arranged below the second spiral 44, is disposed in the first conveyance chamber 22*c*. The second spiral 44 is disposed in the second conveyance chamber 22*d*, which is arranged above the first conveyance chamber 22*c*. Here, the second spiral 44 is arranged to the upper left of the first spiral 43 at an angle of 45 degrees or more (here about 50 degrees) in FIG. 2.

The first and second spirals 43 and 44 stir the developer to thereby charge the toner in the developer to a predetermined level. Thereby, the toner is held by the carrier. Furthermore, at two opposite end portions of the partition section 22*b* in its longitudinal direction (a direction perpendicular to the sheet on which FIG. 2 is drawn), the partition section 22*b* dividing the first conveyance chamber 22*c* and the second conveyance chamber 22*d* from each other, communication sections (a first communication section 22*e* and a second communication section 22*f*, of which both will be described later) are disposed. When the first spiral 43 rotates, the charged developer is conveyed to the second spiral 44 through one of the communication sections disposed at the partition section 22*b*, and the developer circulates in the first conveyance chamber 22*c* and the second conveyance chamber 22*d*. Then, the developer is supplied from the second spiral 44 to the developing roller 20 to form a magnetic brush on the developing roller 20.

The developing roller 20 is constituted by including a fixed shaft (not shown) and a developing sleeve 20*a* formed in a cylindrical shape. The developing sleeve 20*a* is rotatably held on the fixed shaft. Near the developing sleeve 20*a*, a regulation blade 21 is disposed at a predetermined distance from the developing sleeve 20*a*. The regulation blade 21 regulates the layer thickness of the magnetic brush formed on the surface of the developing sleeve 20*a*. The developing sleeve 20*a* is caused by a driving mechanism including a motor and a gear, of which none is illustrated, to rotate in a direction (a clockwise direction) indicated by an arrow in FIG. 2. Furthermore, to the developing sleeve 20*a*, a developing bias is applied which is obtained by superposing an alternating current voltage on a direct current voltage.

When the developing sleeve 20*a*, to which the developing bias is applied, rotates in the clockwise direction in FIG. 2, a potential difference between the developing bias and the exposed portion of the photosensitive drum 11 causes the toner carried on the surface of the developing sleeve 20*a* to be supplied to the photosensitive drum 11. The toner sequentially adheres to the exposed portion of the photosensitive drum 11, rotating in a counter-clockwise direction, such that an electrostatic latent image on the photosensitive drum 11 is developed with the toner.

Next, a detailed description will be given of a stirring section of the developing device 2.

Figure 3:
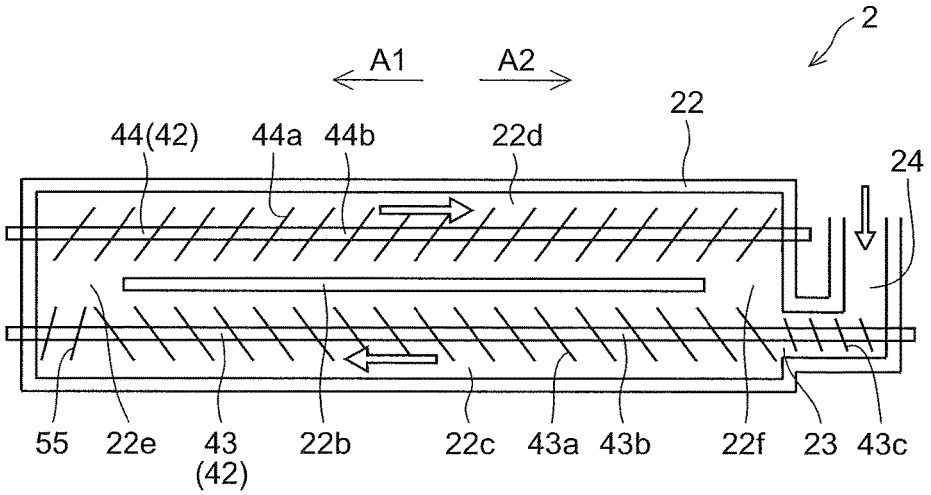
FIG. 3 is a sectional view showing the structure of the developing device of the first embodiment of the present disclosure.

As described above, in the developing container 22, as shown in FIG. 3, the partition section 22*b*, the first conveyance chamber 22*c*, the second conveyance chamber 22*d*, the first communication section 22*e*, and the second communication section 22*f* are formed.

The partition section 22*b* divides the first conveyance chamber 22*c* and the second conveyance chamber 22*d* from each other such that they are arranged one above the other to be parallel to each other. The first communication section 22*e* and the second communication section 22*f* are respectively formed at one side and the other side (an A1-direction side and an A2-direction side) of the partition section 22*b* in its longitudinal direction. The first communication section 22*e* allows the first conveyance chamber 22*c* and the second conveyance chamber 22*d* to communicate with each other at their A1-direction (first-direction) end portions. The second communication section 22*f* allows the first conveyance chamber 22*c* and the second conveyance chamber 22*d* to communicate with each other at their A2-direction (second-direction) end portions. This allows the developer to circulate in the first conveyance chamber 22*c*, the first communication section 22*e*, the second conveyance chamber 22*d*, and the second communication section 22*f*.

The first spiral 43, which is disposed in the first conveyance chamber 22*c*, has a rotary shaft 43*b* and a first spiral blade (spiral blade) 43*a* which is integrally disposed on the rotary shaft 43*b* and formed in a spiral shape with a predetermined pitch in an axial direction of the rotary shaft 43*b*. The rotary shaft 43*b* is rotatably supported in the developing container 22. The first spiral blade 43*a* is formed to extend in a longitudinal direction of the first conveyance chamber 22*c* to positions where the first spiral blade 43*a* faces the first communication section 22*e* and the second communication section 22*f*. The first spiral blade 43*a* rotates in the clockwise direction in FIG. 2, and thereby conveys the developer in the first conveyance chamber 22*c* in the A1 direction, while stirring the developer.

On the portion of the first spiral 43 that faces the first communication section 22*e*, a reverse spiral blade 55 is integrally disposed, which is arranged downstream of the first spiral blade 43*a* in the A1 direction (the developer conveyance direction), and is opposite in winding direction (in the opposite phase) to the first spiral blade 43*a*. The reverse spiral blade 55 is formed with a diameter substantially equal to that of the first spiral blade 43*a*. Since the reverse spiral blade 55 and the first spiral blade 43*a* are opposite to each other in winding direction, the developer conveyed by the first spiral blade 43*a* and the developer conveyed by the reverse spiral blade 55 collide with each other at the first communication section 22*e*, and this applies pressure to the developer, and the developer is thereby heaped up high. Eventually, the developer is conveyed from the first conveyance chamber 22*c* into the second conveyance chamber 22*d*.

Furthermore, in an end surface of the first conveyance chamber 22*c* in the A2 direction, a toner replenishing port 23 is disposed through which the toner is replenished into the developing container 22. To the toner replenishing port 23, there is connected a toner replenishing path 24, which leads, and is connected, to a toner container (not shown). The rotary shaft 43*b* is arranged to extend, passing through the toner replenishing port 23, into the toner replenishing path 24. On the portion of the rotary shaft 43*b* that is located inside the toner replenishing path 24, a replenishing blade 43*c* is integrally formed in a shape of a spiral with a constant pitch in the axial direction of the rotary shaft 43*b*. The replenishing blade 43*c* is a spiral blade wound in the same direction (in the same phase) as the first spiral blade 43*a*, with a pitch and a diameter smaller than those of the first spiral blade 43*a*.

The second spiral 44, which is disposed in the second conveyance chamber 22*d*, includes a rotary shaft 44*b* and a second spiral blade 44*a*. The second spiral blade 44*a* is integrally disposed on the rotary shaft 44*b*, and is formed with a blade wound in the shape of a spiral that is opposite in winding direction (in the opposite phase) to the first spiral blade 43*a*, with the same pitch as the first spiral blade 43*a* in an axial direction of the rotary shaft 44*b*. Further, the second spiral blade 44*a* has a length longer than an axial length of the developing roller 20, and is formed to extend to positions at which the second spiral blade 44*a* faces the first communication section 22*e* and the second communication section 22*f*. The rotary shaft 44*b* is arranged parallel to the rotary shaft 43*b*, and is rotatably supported in the developing container 22. The second spiral blade 44*a* rotates in the clockwise direction in FIG. 2, and thereby supplies the developer in the second conveyance chamber 22*d* to the developing roller 20, while stirring the developer and conveying the developer in the A2 direction (which is opposite to the A1 direction).

In the developing device 2, the developer in the first conveyance chamber 22*c* is conveyed by the first spiral 43 to one side (the first communication section-22*e* side), while being stirred, and gradually accumulates on the one side of the first conveyance chamber 22*c*. On the one side of the first conveyance chamber 22*c*, the developer is heaped up high by the conveying force of the first spiral blade 43*a* the reverse spiral blade 55, and as a result, the developer is pushed up into the second conveyance chamber 22*d* via the first communication section 22*e*.

Then, the developer is supplied to the developing roller 20, while being conveyed toward the other side (the second communication section-22*f* side), while being stirred, by the second spiral 44. The developer remaining on the developing roller 20 without being used for development, falls from the developing roller 20, and is collected in the second conveyance chamber 22*d*. Then, the collected developer is conveyed by the second spiral 44 to the other side of the second conveyance chamber 22*d*, and falls into the first conveyance chamber 22*c* via the second communication section 22*f*.

Figure 4:
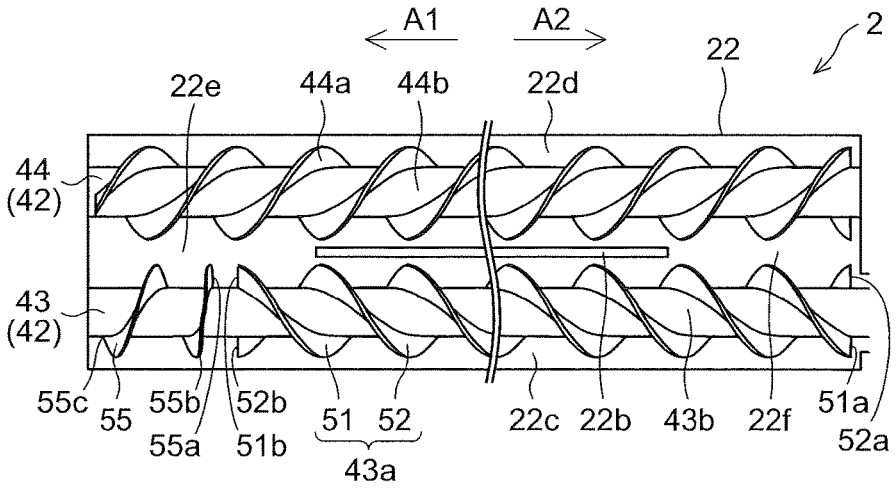
FIG. 4 is a sectional view showing detailed structures of a first spiral blade, a reverse spiral blade, and a second spiral blade of the developing device of the first embodiment of the present disclosure.

Here, as shown in FIG. 4, in the present embodiment, the first spiral blade 43*a* is constituted by a plurality of (here, two) spiral blades. That is, the first spiral blade 43*a* includes a first blade 51 and a second blade 52. An upstream end (a right end) 51*a* of the first blade 51 in the developer conveyance direction (the A1 direction) and an upstream end (a right end) 52*a* of the second blade 52 in the developer conveyance direction (the A1 direction) are located at substantially the same position in the developer conveyance direction. A downstream end (a left end) 51*b* of the first blade 51 in the developer conveyance direction and a downstream end (a left end) 52*b* of the second blade 52 in the developer conveyance direction are located at substantially the same position in the developer conveyance direction. Note that, like the first spiral blade 43*a*, the second spiral blade 44*a* is also constituted by a plurality of (here, two) spiral blades.

The reverse spiral blade 55 is constituted by a single spiral blade. Further, the reverse spiral blade 55 is formed such that a distance L1 (see FIG. 5) between the downstream end 51*b* of the first blade 51 and the reverse spiral blade 55 is substantially equal to a distance L2 (see FIG. 5) between the downstream end 52*b* of the second blade 52 and the reverse spiral blade 55.

Figure 5:
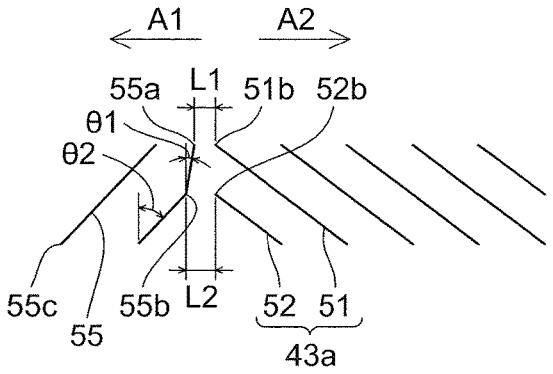
FIG. 5 is a developed view of the first spiral blade and the reverse spiral blade of the developing device of the first embodiment of the present disclosure.

Specifically, as shown in FIG. 4 and FIG. 5, a lead angle (an angle of inclination of the blade with respect to a plane perpendicular to the axial direction of the rotary shaft 43*b*) θ1 (see FIG. 5) of a portion near an upstream end (a right end) 55*a* of the reverse spiral blade 55 in the A1 direction is formed smaller than a lead angle θ2 (see FIG. 5) of other portions of the reverse spiral blade 55.

In more detail, the downstream end 51*b* of the first blade 51 is opposite (adjacent) to the upstream end 55*a* of the reverse spiral blade 55, but the downstream end 52*b* of the second blade 52 is not opposite (adjacent) to the upstream end 55*a* of the reverse spiral blade 55. The downstream end 52*b* of the second blade 52 is opposite (adjacent) to a portion of the reverse spiral blade 55 that is away from the upstream end 55*a* in the A1 direction by an angle of 180 degrees (hereinbelow, the portion will be referred to as the second-blade opposing portion 55*b*). In the reverse spiral blade 55, the lead angle at a portion from the upstream end 55*a* to the second-blade opposing portion 55*b* is set to θ1, and the lead angle at a portion of the reverse spiral blade 55 from the second-blade opposing portion 55*b* to the downstream end 55*c* in the A1 direction is set to θ2. In this configuration, the distance L1 between the downstream end 51*b* of the first blade 51 and the upstream end 55*a* of the reverse spiral blade 55 is substantially equal to the distance L2 between the downstream end 52*b* of the second blade 52 and the second-blade opposing portion 55*b* of the reverse spiral blade 55.

Figure 6:
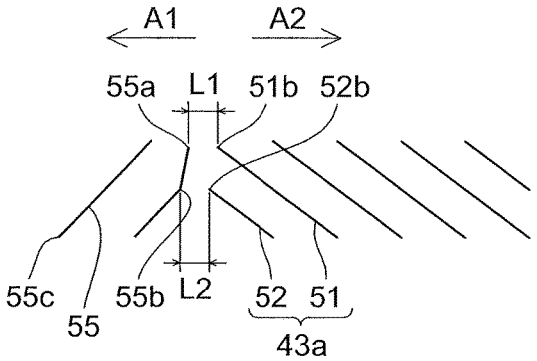
FIG. 6 is a developed view of a modified example of the first spiral blade and the reverse spiral blade of the first embodiment of the present disclosure.

Here, as in a modified example of the first embodiment shown in FIG. 6, the downstream end 51*b* of the first blade 51 may be arranged on an upstream side (a right side) of the downstream end 52*b* of the second blade 52 in the A1 direction. In this configuration, the distance L1 between the downstream end 51*b* of the first blade 51 and the reverse spiral blade 55 is more equal to the distance L2 between the downstream end 52*b* of the second blade 52 and the reverse spiral blade 55.

In the present embodiment, as described above, the distances L1 and L2 between the downstream ends 51*b* and 52*b* of the plurality of blades constituting the first spiral blade 43*a*, which is a multiple-spiral blade, of the first spiral 43 and the reverse spiral blade 55 are substantially equal to each other. This makes it possible to reduce difference between the pressure applied to the developer at the downstream end 51*b* of the first spiral blade 43*a* and the pressure applied to the developer at the downstream end 52*b* of the first spiral blade 43*a*, and thus to reduce variation of the pressure applied to the developer caused in the first communication section 22*e* along with the rotation of the first spiral 43. Hence, it is possible to reduce sliding-down of the developer resulting from reduction of pressure applied thereto, and thus to alleviate the reduction or the destabilization of the conveyed amount of developer.

Further, the second conveyance chamber 22*d* is arranged above the first conveyance chamber 22*c*. Thereby, it is possible to make the developing device 2 compact in the horizontal direction, and this helps make the color printer 100 compact. The compact developing device 2 is particularly advantageous in color image forming apparatuses, in which a plurality of (for example, four) developing devices 2 are arranged in the horizontal direction.

As described above, the lead angle θ1 near the upstream end 55*a* of the reverse spiral blade 55 is smaller than the lead angle θ2 at other portions of the reverse spiral blade 55. This makes it easy to make the distances L1 and L2 between the downstream ends 51*b* and 52*b* of the first spiral blade 43*a* and the reverse spiral blade 55 substantially equal.

Further, as described above, the downstream end 51*b* of the first blade 51 may be arranged upstream of the downstream end 52*b* of the second blade 52 in the A1 direction. This configuration helps make the distance L1 between the downstream end 51*b* of the first blade 51 and the upstream end 55*a* of the reverse spiral blade 55 more equal to the distance L2 between the downstream end 52*b* of the second blade 52 and the second-blade opposing portion 55*b* of the reverse spiral blade 55.

Further, as described above, the reverse spiral blade 55 is formed such that the lead angle is smaller in a region thereof from the upstream end 55*a* to the second-blade opposing portion 55*b* than in the other portions. Thereby, the region having a small lead angle can be made small enough to make it possible to alleviate reduction of developer conveying force of the reverse spiral blade 55.

Further, as described above, the developer is a two-component developer which contains a toner and a carrier. A two-component developer containing a toner and a carrier is higher in flowability than a one-component developer containing only a toner, and thus, it is particularly advantageous to apply the present disclosure to cases where a two-component developer is used.

Second Embodiment

Figure 7:
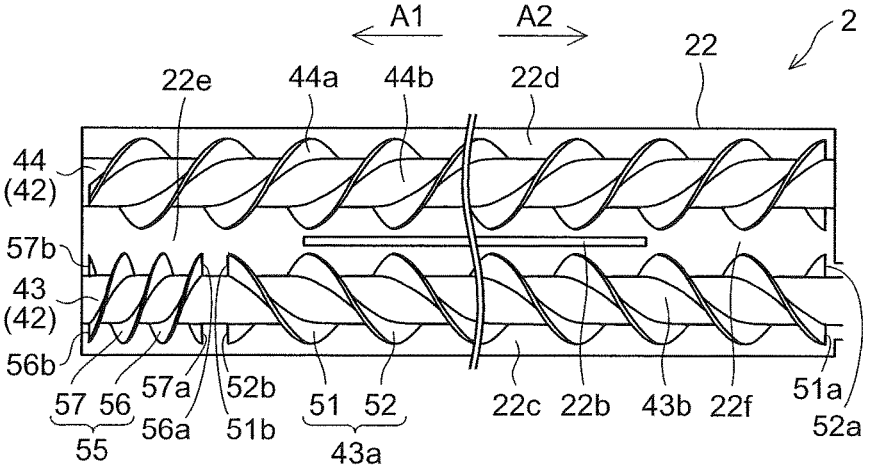
FIG. 7 is a sectional view showing detailed structures of a first spiral blade, a reverse spiral blade and a second spiral blade of a second embodiment of the present disclosure.

In a developing device 2 of a second embodiment of the present disclosure, as shown in FIG. 7, a reverse spiral blade 55 is constituted by the same number of (here, two) spiral blades as a first spiral blade 43*a*. That is, the reverse spiral blade 55 includes a first reverse spiral blade 56 and a second reverse spiral blade 57. The first reverse spiral blade 56 and the second reverse spiral blade 57 are formed such that the lead angle is θ2 in all regions thereof.

An upstream end (a right end) 56*a* of the first reverse spiral blade 56 in the A1 direction and an upstream end (a right end) 57*a* of the second reverse spiral blade 57 in the A1 direction are located at substantially the same position in the A1 direction. Further, a downstream end (a left end) 56*b* of the first reverse spiral blade 56 in the A1 direction and a downstream end (a left end) 57*b* of the second reverse spiral blade 57 in the A1 direction are located at substantially the same position in the A1 direction.

Figure 8:
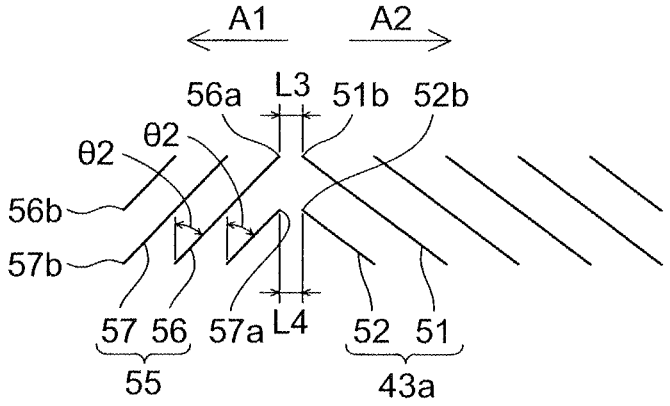
FIG. 8 is a developed view of the first spiral blade and the reverse spiral blade of the developing device of the second embodiment of the present disclosure.

As shown in FIG. 7 and FIG. 8, the downstream end 51*b* of the first blade 51 is opposite (adjacent) to the upstream end 56*a* of the first reverse spiral blade 56, and the downstream end 52*b* of the second blade 52 is opposite (adjacent) to the upstream end 57*a* of the second reverse spiral blade 57. And, a distance L3 (=L1) between the downstream end 51*b* of the first blade 51 and the upstream end 56*a* of the first reverse spiral blade 56 is equal to a distance L4 between the downstream end 52*b* of the second blade 52 and the upstream end 57*a* of the second reverse spiral blade 57.

Other structures of the second embodiment are similar to those of the first embodiment described above.

In the present embodiment, as described above, the reverse spiral blade 55 is constituted by the same number of (here, two) blades as the first spiral blade 43*a*, and the upstream ends 56*a* and 57*a* of the reverse spiral blade 55 are opposite to, and at the same distance from, the downstream ends 51*b* and 52*b*, respectively, of the first spiral blade 43*a*. Thereby, it is possible to more effectively moderate the variation of the pressure applied to the developer caused in the first communication section 22*e* along with the rotation of the first spiral 43, and thus to more effectively alleviate the reduction or the destabilization of the conveyed amount of developer.

Other advantages of the second embodiment are similar to those of the first embodiment described above.

It should be understood that the embodiments disclosed herein are merely illustrative in all respects, and should not be interpreted restrictively. The range of the present disclosure is shown not by the above descriptions of the embodiments but by the scope of claims for patent, and it is intended that all modifications within the meaning and range equivalent to the scope of claims for patent are included.

For example, in the above embodiments, the present disclosure is applicable not only to tandem type color printers like the one shown in FIG. 1, but also to various image forming apparatuses including both digital and analog types of monochrome copiers, color copiers, facsimile machines, and so on that each incorporate a developing device including a first conveyance chamber and a second conveyance chamber arranged above the first conveyance chamber.

Furthermore, although the above embodiments have dealt with examples where a developer is supplied to a developing roller from a stirring-conveyance member, they are by no means meant to limit the scope of the present disclosure. A developer carrier such as a magnetic roller or the like may further be disposed between a stirring-conveyance member and a developing roller, such that the developer is supplied from the stirring-conveyance member to the magnetic roller or the like and then the developer is supplied from the magnetic roller or the like to the developing roller.

Moreover, although the first embodiment has dealt with an example where the lean angle of the reverse spiral blade 55 near the upstream end 55*a* is constant (θ1), this is by no means meant to limit the present disclosure. For example, the lead angle near the upstream end 55*a* of the reverse spiral blade 55 may be made gradually smaller toward the upstream end 55*a*.

What is claimed is:

1. A developing device comprising:

a developing container which includes a first conveyance chamber and a second conveyance chamber arranged above the first conveyance chamber, and contains a developer which contains a toner;

a first stirring-conveyance member which is rotatably supported in the first conveyance chamber, and conveys the developer in the first conveyance chamber in a first direction, while stirring the developer;

a second stirring-conveyance member which is rotatably supported in the second conveyance chamber, and conveys the developer in the second conveyance chamber in a second direction opposite to the first direction, while stirring the developer; and a developer carrier which is rotatably supported in the developing container, and carries on a surface thereof the developer in the first conveyance chamber or the second conveyance chamber, wherein the developing container further includes a partition section which divides the first conveyance chamber and the second conveyance chamber from each other, a first communication section which allows the first conveyance chamber and the second conveyance chamber to communicate with each other at downstream-side end portions thereof in the first direction, and a second communication section which allows the first conveyance chamber and the second conveyance chamber to communicate with each other at downstream-side end portions thereof in the second direction, the first stirring-conveyance member includes a rotary shaft, a plurality of spiral blades which are formed on an outer peripheral surface of the rotary shaft, and a reverse spiral blade which is arranged downstream of the plurality of spiral blades in the first direction so as to face the first communication section, and which is opposite in winding direction to the plurality of spiral blades, downstream ends of the plurality of spiral blades in the first direction are located substantially equally distant from the reverse spiral blade, the reverse spiral blade includes a reverse spiral blade, and a lead angle near an upstream end of the reverse spiral blade in the first direction is smaller than lead angles at other portions of the reverse spiral blade.

2. The developing device according to claim 1, wherein the plurality of spiral blades include a first blade of which a downstream end in the first direction is opposite to the upstream end of the reverse spiral blade, and a second blade of which a downstream end in the first direction is not opposite to the upstream end of the reverse spiral blade, and the downstream end of the first blade is arranged upstream of the downstream end of the second blade in the first direction.

3. The developing device according to claim 1, wherein the plurality of spiral blades include a first blade of which a downstream end in the first direction is opposite to the upstream end of the reverse spiral blade, and a second blade of which a downstream end in the first direction is not opposite to the upstream end of the reverse spiral blade, and a region in the reverse spiral blade from the upstream end thereof to a second-blade opposing portion, which is opposite to the downstream end of the second blade, is formed to have a lead angle smaller than lead angles of other portions of the reverse spiral blade.

4. The developing device according to claim 1, wherein the developer is a two-component developer which contains the toner and a carrier.

5. An image forming apparatus comprising the developing device according to claim 1.

6. A developing device comprising:

a developing container which includes a first conveyance chamber and a second conveyance chamber arranged above the first conveyance chamber, and contains a developer which contains a toner;

a first stirring-conveyance member which is rotatably supported in the first conveyance chamber, and conveys the developer in the first conveyance chamber in a first direction, while stirring the developer;

a second stirring-conveyance member which is rotatably supported in the second conveyance chamber, and conveys the developer in the second conveyance chamber in a second direction opposite to the first direction, while stirring the developer; and a developer carrier which is rotatably supported in the developing container, and carries on a surface thereof the developer in the first conveyance chamber or the second conveyance chamber, wherein the developing container further includes a partition section which divides the first conveyance chamber and the second conveyance chamber from each other, a first communication section which allows the first conveyance chamber and the second conveyance chamber to communicate with each other at downstream-side end portions thereof in the first direction, and a second communication section which allows the first conveyance chamber and the second conveyance chamber to communicate with each other at downstream-side end portions thereof in the second direction, the first stirring-conveyance member includes a rotary shaft, a plurality of spiral blades which are formed on an outer peripheral surface of the rotary shaft, and a reverse spiral blade which is arranged downstream of the plurality of spiral blades in the first direction so as to face the first communication section, and which is opposite in winding direction to the plurality of spiral blades, downstream ends of the plurality of spiral blades in the first direction are located substantially equally distant from the reverse spiral blade, the reverse spiral blade includes a plurality of reverse spiral blades of a number equal to a number of the plurality of spiral blades, and upstream ends of the reverse spiral blades are each located opposite to, and at an equal distance from, a corresponding one of the downstream ends of the plurality of spiral blades.

7. The developing device according to claim 6, wherein the developer is a two-component developer which contains the toner and a carrier.

8. An image forming apparatus comprising the developing device according to claim 6.

* * * * *